United States Patent [19]

Hill et al.

[11] 4,089,626

[45] May 16, 1978

[54] INJECTOR PUMP

[75] Inventors: Homer Hill; Alfred L. Dunn, both of Tulsa, Okla.

[73] Assignee: Dover Corporation, Tulsa, Okla.

[21] Appl. No.: 642,749

[22] Filed: Dec. 22, 1975

[51] Int. Cl.[2] ..... F04B 39/02; F04B 39/06

[52] U.S. Cl. ..... 417/431

[58] Field of Search ..... 417/432, 503, 554

[56] References Cited

U.S. PATENT DOCUMENTS

| | | | |
|---|---|---|---|
| 732,241 | 6/1903 | Vaniman | 417/503 |
| 862,456 | 8/1907 | Feeny | 417/431 |
| 1,075,261 | 10/1913 | Kilburn | 417/432 |
| 1,421,004 | 6/1922 | Hibbard | 417/432 |
| 1,437,939 | 12/1922 | Green | 417/503 |
| 1,474,718 | 11/1923 | Humason | 417/431 |
| 1,483,143 | 2/1924 | Whitlock | 417/430 |
| 1,703,354 | 2/1929 | Nevill | 417/554 |
| 2,371,846 | 3/1945 | Ruthven | 417/430 |
| 2,405,697 | 8/1946 | Houston et al. | 417/432 |
| 2,464,347 | 3/1949 | Roofe | 417/554 |
| 3,418,938 | 12/1968 | Vincent | 417/431 |
| 3,592,567 | 7/1971 | Tolbert | 417/432 |

*Primary Examiner*—William L. Freeh

*Attorney, Agent, or Firm*—Head, Johnson & Chafin

[57] ABSTRACT

An injection pump comprising a barrel and plunger type tubing pump for pumping liquid from a deep borehole through tubing while injecting a treating liquid down through a hollow sucker rod. Just above the traveling valve is a blender coupling means. The hollow passage through the sucker rod communicates through an injector pipe to the top of a shallow bore in the top of the blender coupling means. There are two drilled openings through the wall so that liquid pumped down the sucker rod passes through the wall into the annular space between the traveling valve and the barrel where it can mix with the entering well liquids in a mixing zone between the traveling valve on the bottom end of the plunger and the standing valve of the barrel. There are a plurality of drilled holes in a circle surrounding the central bore in the blender coupling so that fluid passing up through the traveling valve can flow upwardly through these drilled holes into an annular space between the internal surface of the barrel and the injector pipe and through a hole in the wall of the plunger, and into the annulus between the sucker rod and the tubing. It then flows up the tubing as in conventional pumps.

3 Claims, 5 Drawing Figures

INJECTOR PUMP

BACKGROUND OF THE INVENTION

This invention lies in the field of tubing pumps. More particularly, it concerns tubing pumps of the plunger and barrel type. Further, it comprises a plunger and barrel tubing pump which has hollow sucker rods and has means for pumping a treating liquid down through a central passage in the sucker rods down through the barrel of the pump to mix with the well fluid in a mixing zone below the traveling valve.

In the prior art, there are devices for pumping a treating liquid down through hollow sucker rods and out through the tubing below a packer so as to be mixed with the well fluids in the well bore below the standing valve. In general, this has involved conduits outside of the tubing which meant that each time the pump is pulled or each time a change is made, the tubing must be pulled from the packer at consequent expense and time.

In this system, the pump is easily pulled from the tubing; and because of the simple changes in the structure between the plunger and the traveling valve and above the plunger in the sucker rod system, the treating fluid can be carried down through the sucker rod, through the wall of the plunger, and into the mixing zone between the standing valve and the traveling valve. All liquid entering the traveling valve is thus treated before its passage up through the pump and tubing.

SUMMARY OF THE INVENTION

It is the primary object of this invention to provide an improved type of tubing pump comprising a plunger and barrel type pump with hollow sucker rods so that a treating liquid may be pumped down the sucker rods and through the barrel, so as to be mixed in a mixing zone above the standing valve with the liquid entering the standing valve from the well bore.

It is a further object of this invention to provide such a pump with features such that the complete pump can be withdrawn at any time without pulling tubing.

These and other objects are realized and the limitations of the prior art are overcome in this invention by providing a modification to the structure in two parts of the moving plunger system.

One is a blender coupling means which is positioned between the plunger and the standing valve. It comprises a cylindrical rod with threaded ends for attachment to the plunger means above and to the traveling valve cage below. There is an axial bore from the top of the coupling means part way down the axis. There are at least one or a plurality of openings radially through the wall of the coupling means so that liquid in the bore along the axis can flow outwardly into the annulus between the outside of the coupling and the outside of the traveling valve cage and inside of the pump barrel extension coupling that supports the standing valve.

There are a plurality of drilled holes arranged in a circle around the axis of the blender coupling means spaced within the thick metal wall outside of the bored opening. Fluid which passes up through the standing valve and up through the traveling valve thus flows up through the drilled openings into an annular space between the plunger barrel on the outside and a thin walled injection tube, which seals to the top of the bored opening at its bottom end and connects to the top of the plunger at its top end. Thus, liquid flowing down through the central opening in the sucker rods flows down through this injection tube, through the wall of the blender coupling means, into the annulus, and downward into the mixing zone between the top of the standing valve and the bottom inlet of the traveling valve. In this mixing zone, the treating liquid mixes with the well fluid before it flows into the traveling valve and up through the pump barrel.

At the top end of the pump barrel where it is sealed to the injection tube, there are a plurality of openings radially through the wall of a discharge cage. Fluid flowing up from the traveling valve will pass out into the annulus between the sucker rods and the tubing, and onwardly and upwardly to the surface.

BRIEF DESCRIPTION OF THE DRAWINGS

These and other objects and advantages of this invention and a better understanding of the principles and details of the invention will be evident from the following description taken in conjunction with the appended drawings in which:

FIG. 1 illustrates the lowermost portion of the pump, including the standing valve, the traveling valve, and the blender coupling.

FIG.2 illustrates the portion of the pump in the general vicinity of the plunger.

FIG. 3 illustrates the portion above the upper end of the plunger where it joins the sucker rods and provides detail of the discharge cage.

FIG. 4 illustrates a portion of the sucker rod assembly above the top of the plunger and includes a check valve in the flow line down through the central opening of the hollow tubing.

DESCRIPTION OF THE PREFERRED EMBODIMENT

Figure 1:
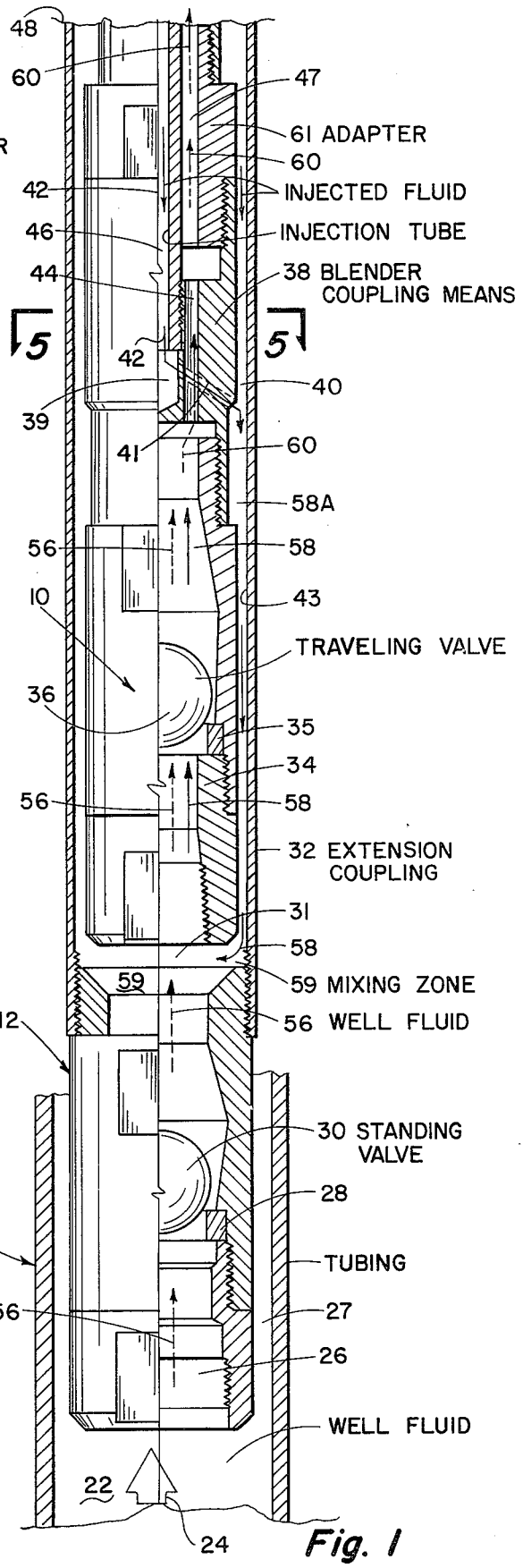

Referring now to the drawings and in particular to FIG. 1, there is shown a view in cross-section of the lowermost portion of the pump of this invention. The numeral 10 indicates generally the traveling valve assembly. Numeral 12 indicates generally the standing valve assembly. Numeral 14 indicates the bottom end of the tubing which is of somewhat larger diameter than the standing valve assembly 12.

The entire assembly of the pump is made of a great many short cylindrical portions which are joined together by screw threads, or other means, to form the complete assembly. Not all of these separate parts will be separately described, only some of the special parts.

The standing valve assembly 12 comprises a tubular portion having a central opening 26 through which well fluids can flow upwardly from the space 22 inside of the tubing, where the well fluids accumulate and then flow upwardly in accordance with the arrow 24 into the bottom of the pump, and through the standing valve, which comprises a ball valve 30 cooperating with a cylindrical seat 28. This provides free movement of liquid upwardly in accordance with arrow 56 but seals against downward flow of liquid through the standing valve.

In the annular space 27 between the tubing 14 and the standing valve 12, and in the space 22 below the standing valve and the space 26 inside of the standing valve into a mixing zone between the traveling valve 10 and the top of the standing valve 12, there is only well fluid flowing in accordance with the arrow 56.

The standing valve is supported by a thin cylindrical tube 32 which is called an extension coupling which is supported at its upper end from the barrel of the pump.

Above the top of the standing valve 12 and inside of the extension coupling tube 32 is the bottom end of the moving plunger system, and in particular the bottom portion is the traveling valve 10. This is a tubular cage having a ball valve 36 which seats on a cylindrical seat 35 of design which is well known in the art. As the plunger moves downwardly, the valve 36 is lifted off its seat as fluid flows in from below and through and under the valve ball, up into the space above the traveling valve in accordance with arrows 56 and 58.

The top end of the traveling valve cage is attached by threads to a blender coupling means 38. This is a short cylindrical rod having threads on the top to connect upwardly to the plunger system, and threads on the bottom end to support the traveling valve. There is an axial cylindrical bore 39 inside of the blender coupling and threads which support a thin cylindrical tube called an injection tube 46.

As will be explained in other figures, the injected fluid flows down in accordance with arrow 42, inside of the injection tube 46 into the top of the bore 39 and out through one or more radial drilled openings 41, and into the annular space 43 between the extension coupling 32 and the outside of the traveling valve 10. This treating fluid flows downwardly in the annular space 43 and in accordance with arrow 58, into the mixing zone 59, previously described. There the treating fluid 58 mixes with the well fluid 56 and as a mixture of 56 and 58 flows upwardly into and through the traveling valve.

Figure 5:
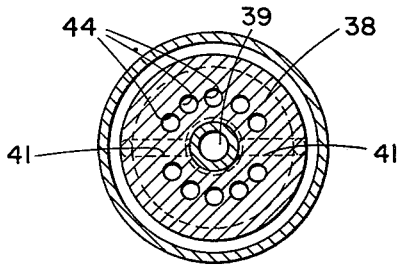
FIG. 5 illustrates a cross-sectional view of the blender coupling means.

The blender coupling 38 has a thick wall through which a plurality of longitudinal openings 44 are drilled on a circle, through the solid part of the annular wall of the coupling. This is shown in greater detail in FIG. 5 where the radial openings 41 previously described are shown from the space 39 inside the bore to the outside wall of the coupling 38. It also shows a plurality of drilled openings 44 parallel to the axis, through the wall of the blender coupling. By this means, the mixture of well fluid 56 and treating fluid 58, as shown by arrows 60, can now flow up through these openings in the blender coupling and up through the annular space 47 between the plunger wall, as shown by the adapter 61, and the outer surface in the injection tube 46.

At the top of FIG. 1, it is seen that treating fluid flows down inside of the injection tube 46 while a mixture of well fluid and treating fluid 60 having mixed in the mixing zone flows upward through the traveling valve, through the openings in the blender coupling assembly, and into the annular space 47 between the injection tube and the barrel.

Figure 2:
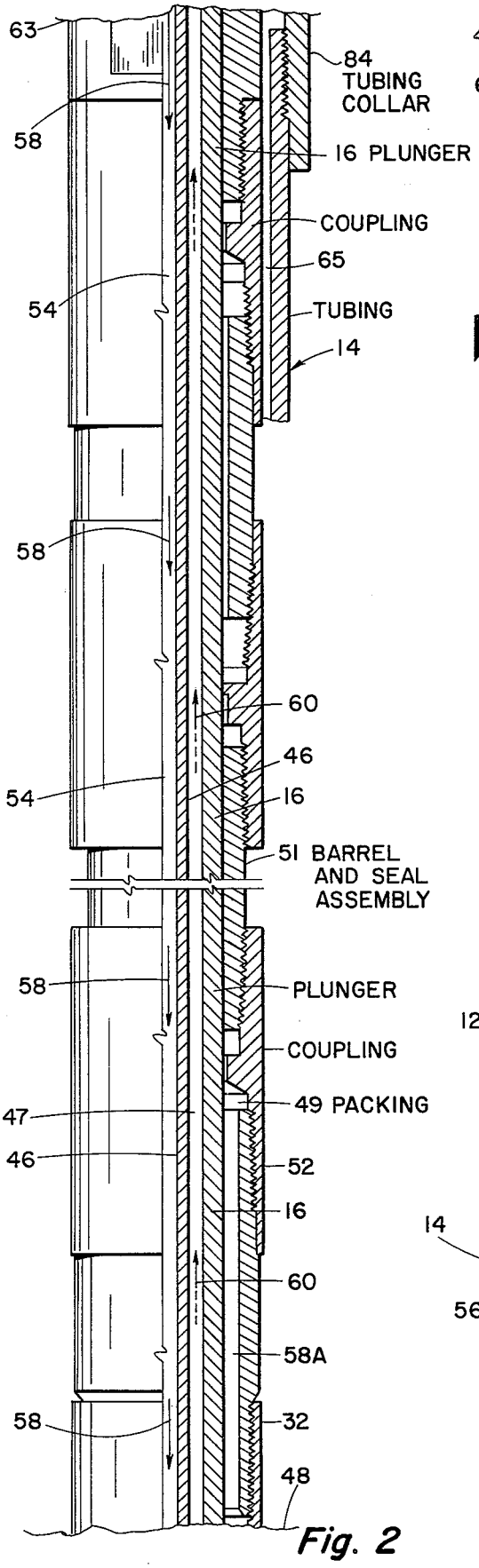
FIGS. 1, 2, 3, and 4 illustrate in partial cross-section successive vertical sections of the improved pump of this invention.

The top 48 of FIG. 1 corresponds to the bottom 48 of FIG. 2. Here again, the arrow 58 indicates flow of treating fluid down inside of the injection tube 46 while combined well fluid and treating fluid mixture 60 flows upward through the annulus 47 inside of the plunger tube 16. The plunger tube 16 seals and slides within the barrel of the pump indicated by numeral 51.

At the upper end 63 of FIG. 2 is shown a tubing collar 84 and the tubing 14 which, as is well understood, extends downward through FIG. 2 and through the top portion of FIG. 1 to join the bottom end of the tubing 14. It will be noted that there is an annular space 65 between the outside of the barrel and the tubing.

Figure 3:
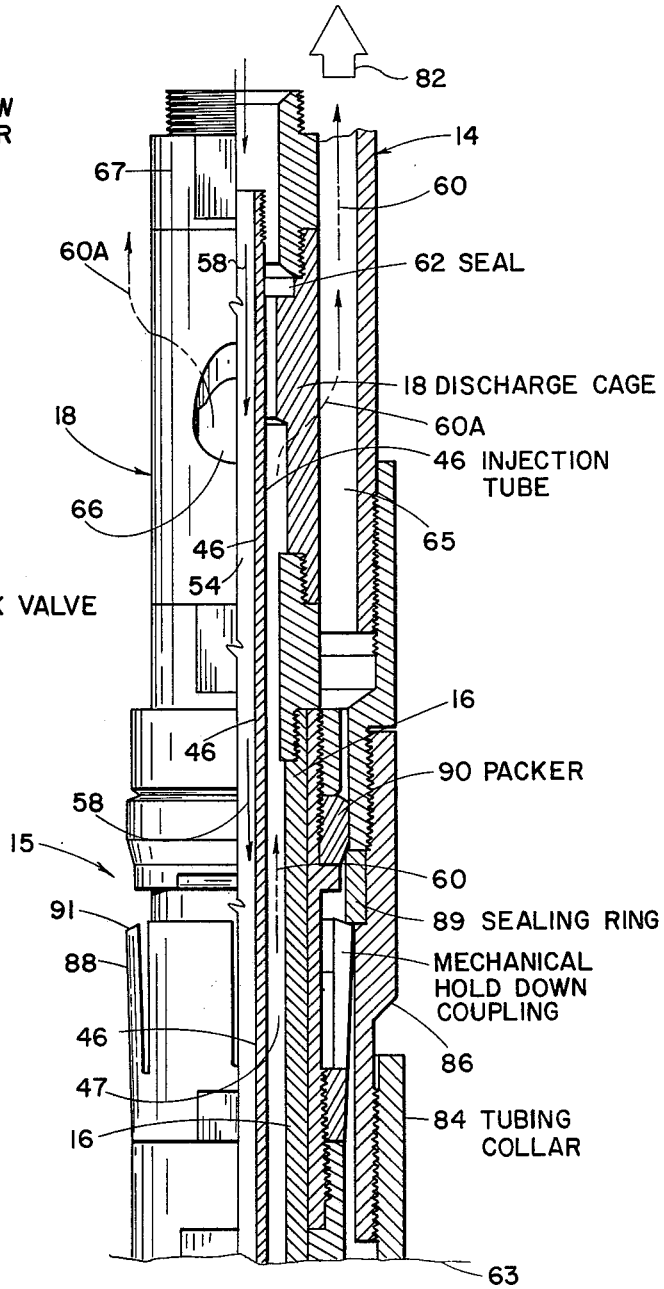

Referring now to FIG. 3, the bottom end 63 joins at the top end 64 of FIG. 2. At the top end of the coupling 84, there is a special holding ring 86 indicated generally by the numeral 15. This includes a mechanical hold down portion 88 which is attached to the top end of the barrel and which is clamped inside of the mechanical hold down coupling 86. There are spring fingers 88 at this point. As the pump is lowered down through the tubing, the fingers 88 are compressed by passage through the seal ring 89. These fingers then lock with their tops at the bottom of the sealing ring 89. On the ends of the fingers there is a sloping top edge 91. If there is a strong pull on the sucker rods, these fingers will be forced inwardly and the pump can then pass up through the sealing ring 89 and be drawn out of the tubing. A fluid seal is provided by the seat or packer 90 which closes off the annular space between the pump and the tubing at this point.

The upper end of the plunger 16 extends above the hold down coupling. The injection tube 46 also extends upwardly, and the two are sealed together near the top of FIG. 3 by means of the seal 62. The portion of the barrel assembly at this point is called the discharge cage 18. Since this is sealed at its top to the injection tube, the well fluid shown by arrow 60 which passes up through the annulus 47 has no egress except through a plurality of openings 66 through the wall of the discharge cage 18. Thus the pumped mixture 60 of well fluid and treating fluid flows through these openings 66 into the annular space 65 between the sucker rod connections at the top of FIG. 3 and the tubing 14. The upward flow of pumped mixture is shown by arrow 82.

Figure 4:
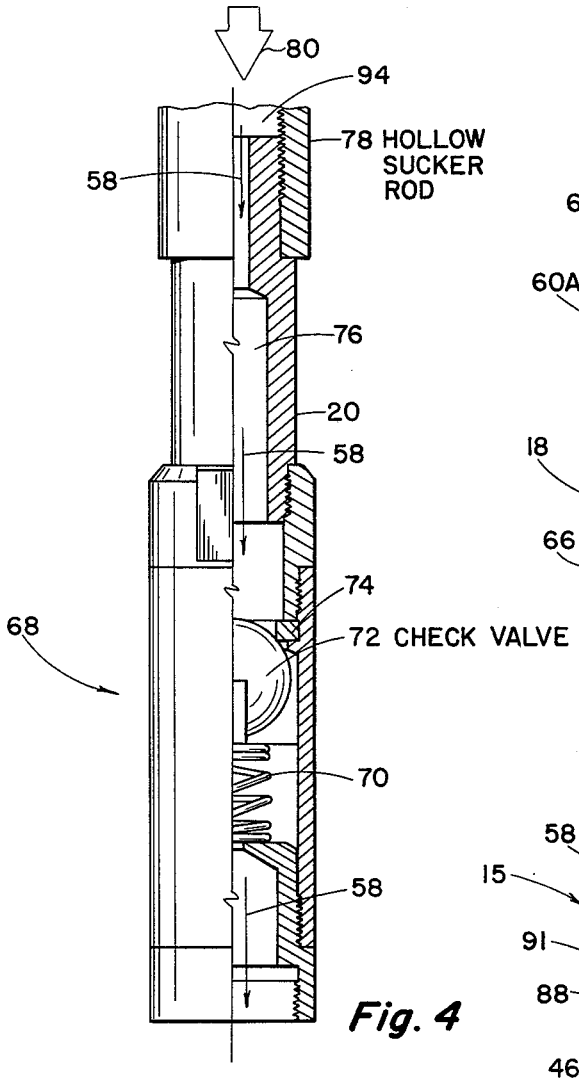

In FIG. 4 is shown a control check valve assembly 68 which screws on top of the portion 67 at the top of FIG. 3. This includes a check valve having a ball 72, which is forced upwardly by a spring 70 which provides a preselected upward force against seat 74. The upper end of the valve assembly is connected by an adapter 20 to the hollow sucker rod 78. The opening 94 though the sucker rod 78 provides means for flow downward in accordance with arrow 80 of the treating fluid 58, down through the check valve 68, and into the injection tube 40 at the top of FIG. 3.

Briefly, the treating fluid is pumped down the hollow sucker rod, down through the check valve 68 as shown in FIG. 4, down through the injection tube 46 through FIG. 3, and through FIG. 2, and down into the top of FIG. 1, where the injection tube ends in the blender coupling means 38. Here, the downgoing treating liquid is bypassed through openings 41 into the annulus 43 between the extension coupling 32 and the traveling valve 10, into the mixing zone 59. There it meets the incoming well fluids in accordance with arrow 56. The mixture then flows upwardly through the traveling valve 10 up through the bored openings 44 and into the annulus 47, between the injection tube and the barrel, as shown in FIG. 1, up through FIG. 2 60 and FIG. 3, through the discharge cage 18, and into the annulus 65 between the tubing 14 and the pump 67, and upwardly as arrow 82.

It is clear from the description that these features of controlled pumping downwardly of treating liquid, which is mixed with the well liquid in the mixing zone and flows back up through the pump, are provided without any disturbance to the outward contour of the pump which might minimize its convenience, its simplicity, and its ability to be inserted and retrieved from the tubing while the tubing remains in position.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claims or claims, including the full range of equivalency to which each element or step thereof is entitled.

What is claimed is:

1. A barrel and plunger type pump for pumping liquid from a deep borehole though tubing while permitting a treating liquid to be injected down a hollow sucker rod to mix with well fluid above the standing valve and below the travelling valve;

(a) a pump barrel of substantial length adapted to be supported in well tubing at a selected level, said barrel supporting a standing valve immersed in the well liquid by means of a first thin cylindrical tube;

(b) pump plunger means of length greater than said barrel adapted to sealably reciprocate in said barrel and including a traveling valve in the bottom of said plunger means, said traveling valve being inside of and of smaller diameter than said first thin tube, and than said plunger, whereby the clearance between said traveling valve and said first thin tube is greater than between said plunger and said barrel;

(c) a mixing zone comprising the volume inside said first thin tube between said standing valve and said traveling valve;

(d) blender coupling means connected between said traveling valve and said plunger means;

(e) a second thin tube or injection tube connected to and extending upwardly of said blender coupling means, and including means to flow well fluid through said blender coupling means upwardly between said injection tube and said plunger means upwardly between said injection tube and said plunger means, to a point above said plunger means and said barrel;

(f) discharge cage means comprising a cylindrical coupling connected to the top of said plunger means and having at least one opening through its wall, and seal means between said discharge cage means and said injection tube above said openings; and (g) hollow sucker rod means connected to said discharge cage means;

whereby treating liquid is forced down said sucker rods, through said blender coupling means, below said plunger means, and downwardly in the annulus between said standing valve and said first thin tube to said mixing zone, where it mixes with the incoming liquid from said standing valve, and the mixture flow upwardly through said blender coupling means and between said injection tube and said plunger means to the annulus above said barrel.

2. The pump as in claim 1 including a spring-backed check valve means in said sucker rod means operating in a direction to prevent upward flow of fluid inside said hollow sucker rod means.

3. The pump as in claim 1 in which said blender coupling means comprises:

(a) a cylindrical metal rod having attachment means on a top end and on the bottom end for connection respectively to said plunger means and said traveling valve;

(b) an axial bore extending from the top end of said metal rod down to a point above the bottom end, providing a closure below said bore, and an annular wall portion;

(c) a plurality of longitudinal drilled holes arranged circumferentially through said annular wall portion of said blender coupling means; and (d) at least one drilled opening between said axial bore and the outside wall of said blender coupling means, between said drilled holes; whereby fluid in said axial bore inside said plunger can flow into the annular space between the outside of said plunger and inside of said first thin tube, to said mixing zone.

* * * * *